US009297259B2

(12) United States Patent
Miller et al.

(10) Patent No.: US 9,297,259 B2
(45) Date of Patent: Mar. 29, 2016

(54) COMPRESSOR BLADE

(75) Inventors: Edward Len Miller, Jupiter, FL (US); Marco Micheli, Schofflisdorf (CH); Tihomir Stojkovic, Karlovac (HR); Luis Federico Puerta, Rieden (CH)

(73) Assignee: Alstom Technology, Baden (CH)

( * ) Notice: Subject to any disclaimer, the term of this patent is extended or adjusted under 35 U.S.C. 154(b) by 698 days.

(21) Appl. No.: 13/523,260

(22) Filed: Jun. 14, 2012

(65) Prior Publication Data

US 2013/0336799 A1 Dec. 19, 2013

(51) Int. Cl.
*F01D 5/14* (2006.01)

(52) U.S. Cl.
CPC ..... *F01D 5/141* (2013.01); *F05D 2240/301* (2013.01); *F05D 2250/74* (2013.01)

(58) Field of Classification Search
CPC . F01D 5/141; F04D 29/324; F05D 2240/301; F05D 2250/74
USPC ..... 415/191, 192, 193, 208.1, 208.2, 209.1, 415/209.2, 209.3, 209.4, 210.1, 211.2; 416/223 R, 242, 243, 223 A, DIG. 2, 416/DIG. 5
See application file for complete search history.

(56) References Cited

U.S. PATENT DOCUMENTS 8,702,384 B2 * 4/2014 Baer et al. ..... 415/191
8,882,456 B2 * 11/2014 Lanese et al. ..... 415/193
2007/0177980 A1 * 8/2007 Keener et al. ..... 416/223 R
2008/0101940 A1 * 5/2008 LaMaster et al. ..... 416/223 R
2008/0101941 A1 * 5/2008 LaMaster et al. ..... 416/223 R
2008/0101944 A1 * 5/2008 Spracher et al. ..... 416/223 R
2008/0101945 A1 * 5/2008 Tomberg et al. ..... 416/223 R
2008/0101946 A1 * 5/2008 Duong et al. ..... 416/223 R
2008/0101947 A1 * 5/2008 Shrum et al. ..... 416/223 R
2008/0101948 A1 * 5/2008 Latimer et al. ..... 416/223 R
2008/0101949 A1 * 5/2008 Spracher et al. ..... 416/223 R
2008/0101950 A1 * 5/2008 Noshi et al. ..... 416/223 R
2008/0101951 A1 * 5/2008 Hudson et al. ..... 416/223 R
2008/0101952 A1 * 5/2008 Duong et al. ..... 416/223 R
2008/0101954 A1 * 5/2008 Latimer et al. ..... 416/223 R
2008/0101955 A1 * 5/2008 McGowan et al. ..... 416/223 R
2008/0101956 A1 * 5/2008 Douchkin et al. ..... 416/223 R
2010/0061862 A1 3/2010 Bonini et al.
2011/0262279 A1 10/2011 Marini et al.
2013/0336799 A1 * 12/2013 Miller et al. ..... 416/241 R

OTHER PUBLICATIONS

PCT Appl. No. PCT/US2013/045912 International Search Report, dated Oct. 24, 2013.

* cited by examiner

*Primary Examiner* — Edward Look
*Assistant Examiner* — Christopher R Legendre
(74) *Attorney, Agent, or Firm* — Shook, Hardy & Bacon LLP

(57) ABSTRACT

A compressor component having an improved airfoil profile so as to eliminate previously known vibratory issues in the blade tip is disclosed. By altering the airfoil profile throughout its span, the natural frequency of the airfoil is altered so as to not coincide with a critical engine order of the compressor. Further, the present invention provides a novel airfoil profile in accordance with the coordinates of Table 1.

20 Claims, 6 Drawing Sheets

COMPRESSOR BLADE

CROSS-REFERENCE TO RELATED APPLICATIONS

Not applicable.

TECHNICAL FIELD

The present invention generally relates to a compressor component having an airfoil and more specifically to an airfoil having a profile that is configured to improve performance of a gas turbine combustor.

BACKGROUND OF THE INVENTION

A compressor typically comprises a plurality of stages, where each stage includes a set of stationary compressor vanes which direct a flow of air into a rotating disk of compressor blades, where each stage of the compressor decreases in diameter, causing the pressure and temperature of the air to increase. Compressor components having an airfoil, such as compressor blades and compressor vanes, are held within disks or carriers and are designed to aid in compressing a fluid, such as air, as it passes through stages of blades and vanes of the compressor.

Axial compressors having multiple stages are commonly used in gas turbine engines for increasing the pressure and temperature of air to a pre-determined level at which point a fuel can be mixed with the air and the mixture ignited. The hot combustion gases then pass through a turbine to provide either a propulsive output or mechanical output.

Compressor components, such as blades and vanes, have an inherent natural frequency, and when the compressor component is excited, as can occur during normal operating conditions, the compressor component vibrates or moves at different orders of the engine's natural frequency. When the natural frequency of the compressor component coincides or crosses an engine order, the compressor component can start to resonate or vibrate in such away that it is excited and can cause cracking or failure of the compressor component.

SUMMARY

In accordance with the present invention, there is provided a novel and improved compressor component having an improved tip region optimized to improve the airflow coming off the compressor blade.

In an embodiment of the present invention, a compressor component has an attachment and an airfoil extending radially outward from the attachment, where the airfoil has a leading edge and a trailing edge, concave and convex surfaces, and a thickness based on the Cartesian coordinate values X, Y, and Z as set forth in Table 1, where Y is a distance measured radially from a root datum plane extending through the attachment of the blade.

In an alternate embodiment of the present invention, a compressor component is disclosed having an attachment and an airfoil extending radially outward from the attachment. The airfoil has an uncoated profile substantially in accordance with Cartesian coordinate values of X, Y, and Z as set forth in Table 1, where Y is a distance measured radially from a root datum plane extending through the attachment to which the airfoil is mounted. The X and Z values are joined by smooth connecting splines to form a plurality of airfoil sections and the sections are joined to form the airfoil profile.

In yet another embodiment, a compressor stator having an altered tip configuration and airfoil tilt in which the compressor stator comprises an attachment and an airfoil extending radially outward from the attachment with the airfoil having a thickness and extending to a generally planar tip.

Although disclosed as an airfoil that is uncoated, it is envisioned that an alternate embodiment of the present invention can include an airfoil that is at least partially coated with an erosion resistant coating, corrosion resistant coating, or a combination thereof. In this case, the coordinates of the airfoil as listed in Table 1 are prior to a coating being applied to any portion of the airfoil.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
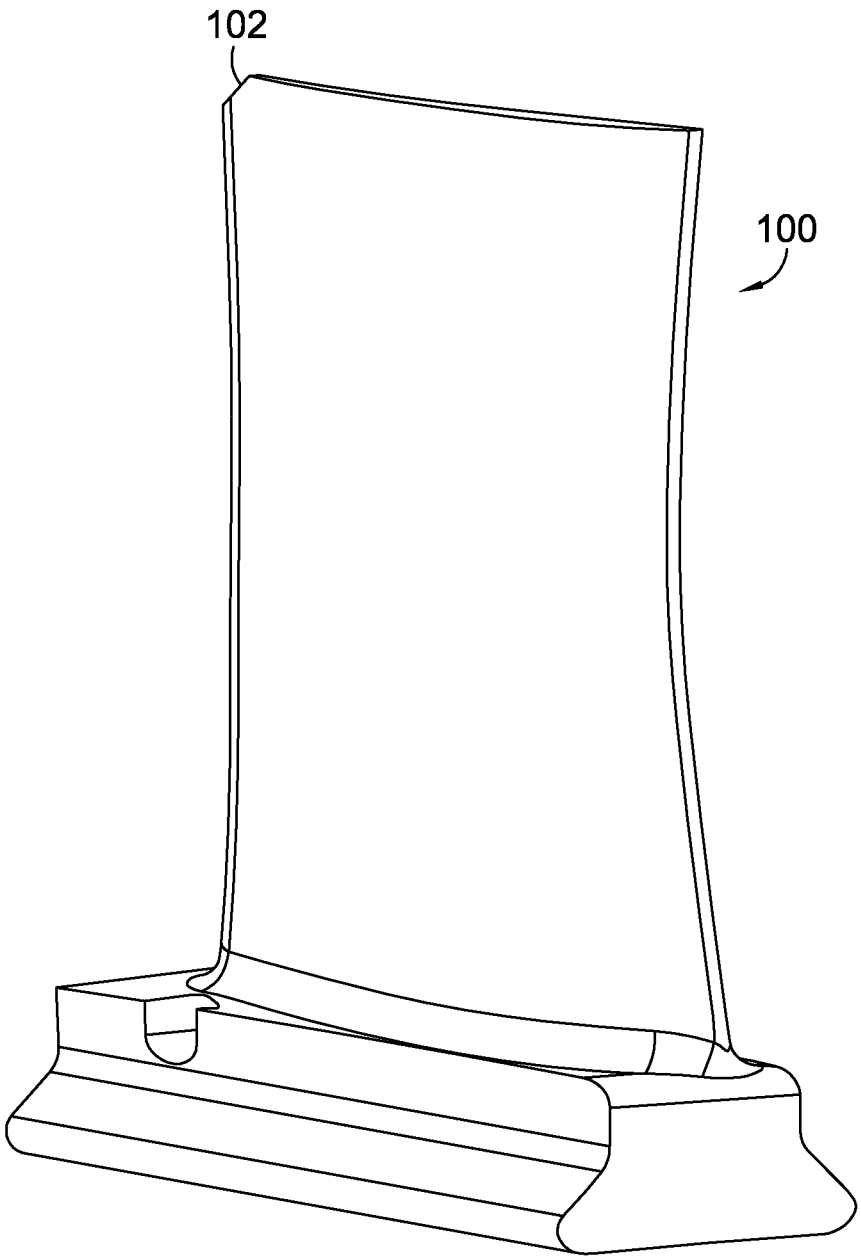
FIG. 1 PRIOR ART
FIG. 1 is a perspective view of a compressor component in accordance with the prior art.

Referring initially to FIG. 1, a prior art compressor blade 100 is depicted. The prior art blade 100 includes a cropped blade tip 102. Because of critical aerodynamic crossings occurring in the airfoil at the tip of the blade 100, vibrations within the airfoil caused a portion of the blade tip to crack and break off during operation. As a fix to this design flaw, suppliers proceeded to remove a portion of the blade tip during manufacturing in order to prevent the blade tip from cracking. However, this cropped blade tip, as shown in FIG. 1 creates a loss in both compressor blade efficiency and overall compressor efficiency.

Figure 3:
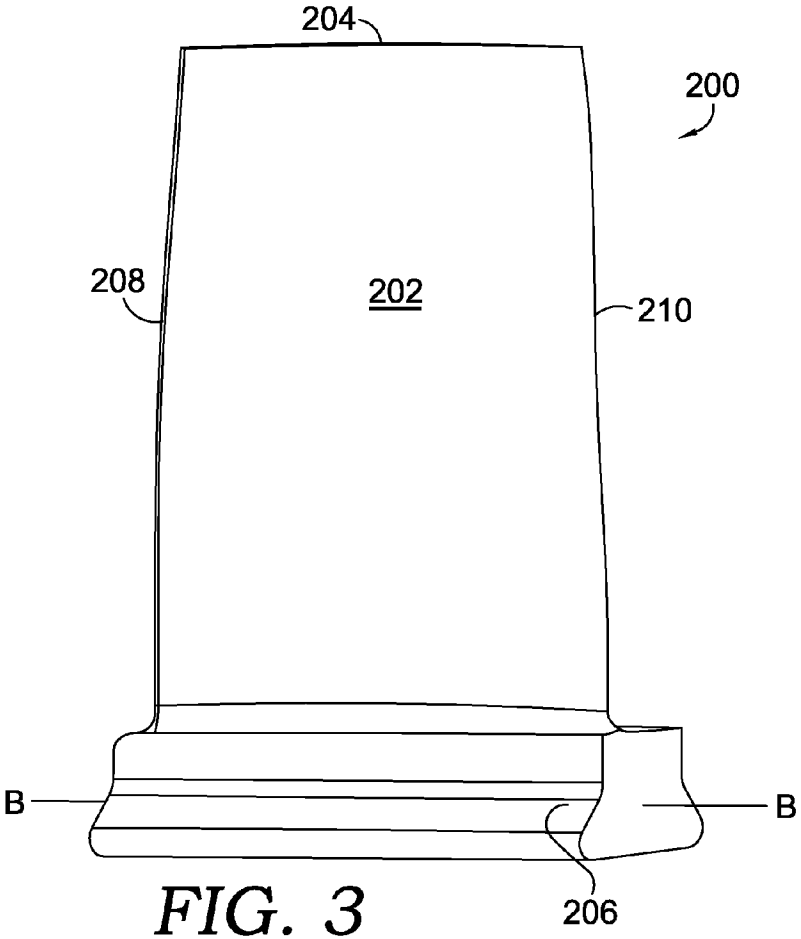
FIG. 3 is an alternate perspective view of the compressor component of FIG. 2 in accordance with an embodiment of the present invention.
Figure 2:
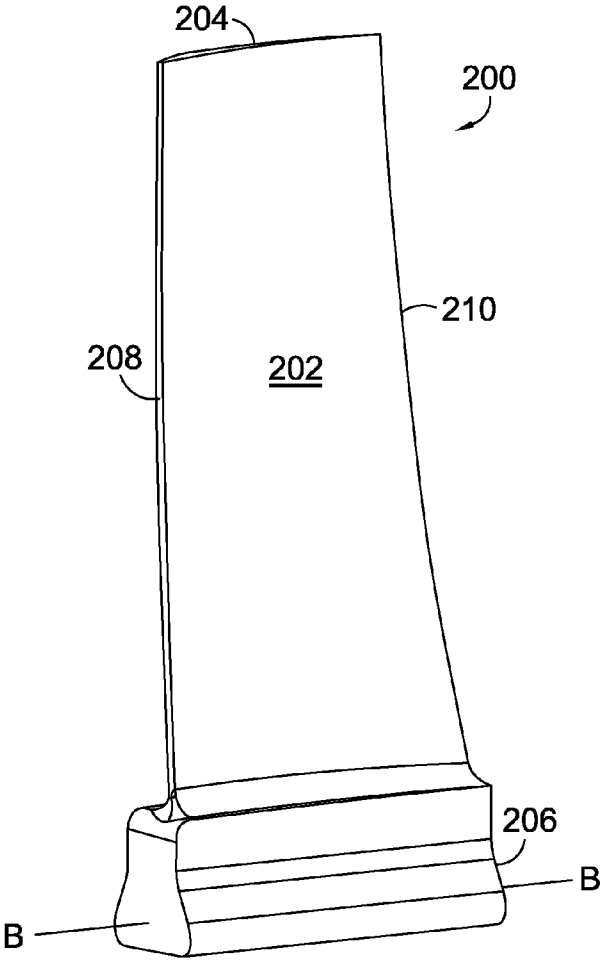
FIG. 2 is an alternate perspective view of the compressor component of FIG. 1 having an airfoil in accordance with an embodiment of the present invention.
Figure 9:
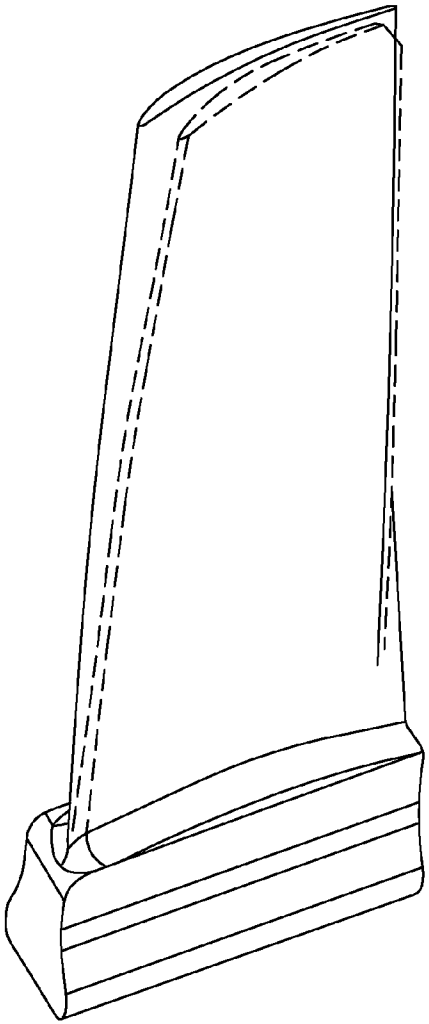
FIG. 9 is a perspective view depicting overlays of the prior art compressor airfoil and the present invention in accordance with an embodiment of the present invention.
Figure 4:
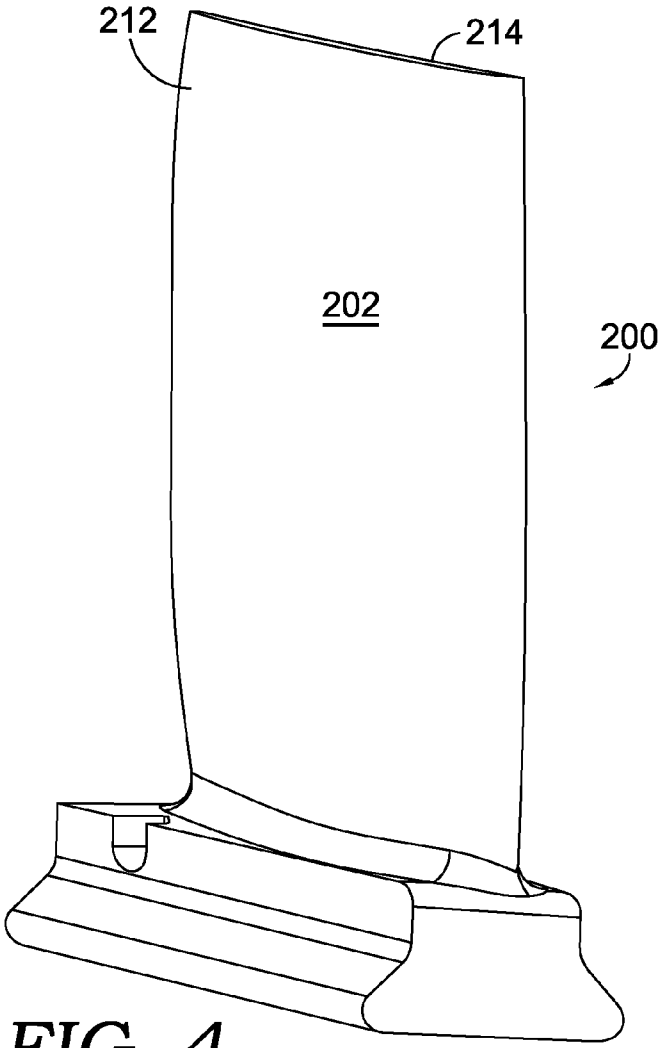
FIG. 4 is yet another perspective view of the compressor component of FIG. 2 in accordance with an embodiment of the present invention.
Figure 5:
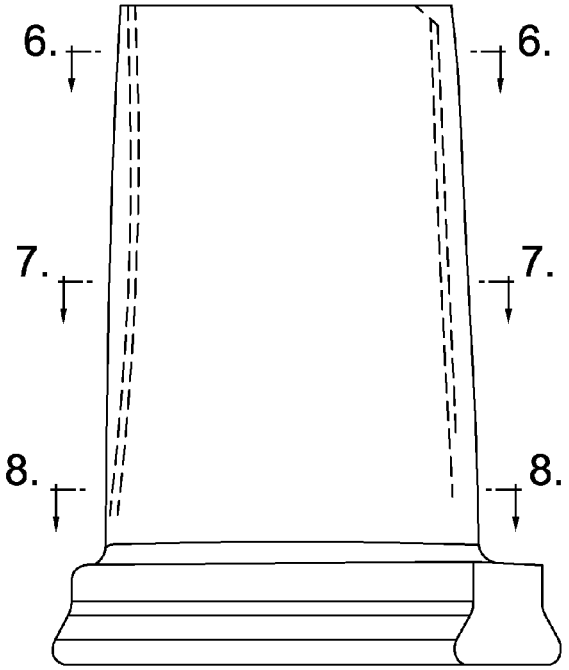
FIG. 5 is an elevation view of a compressor blade depicting an airfoil in accordance with the prior art component overlaid with an airfoil in accordance with an embodiment of the present invention.

The present invention seeks to overcome the shortcomings of the prior art, including the "cropped airfoil" configuration, by providing a redesigned airfoil portion of a compressor blade that eliminates the cracking of the blade tip and the need to remove a portion of the blade tip during manufacturing. Referring to FIGS. 2-4, the present invention is directed towards a compressor component, such as a compressor blade, where the compressor component 200 has a redesigned shape to the airfoil 202. While the general profile of the airfoil 202 has changed, the changes are most noticeable towards a tip 204 of the airfoil 202, as can be seen in the comparison between compressor blades in FIG. 9, where the solid line represents the present invention and the dashed line represents the prior art airfoil configuration.

An embodiment of the present invention also comprises an attachment 206 for securing the compressor component 200 to a disk (not shown). The airfoil 202, which is preferably solid, extends radially outward from the attachment 206 and has a leading edge 208 and a trailing edge 210 with the trailing edge 210 spaced a distance from the leading edge 208 and separated by a concave surface 214 and convex surface 212, as shown in FIG. 4.

Figure 6:
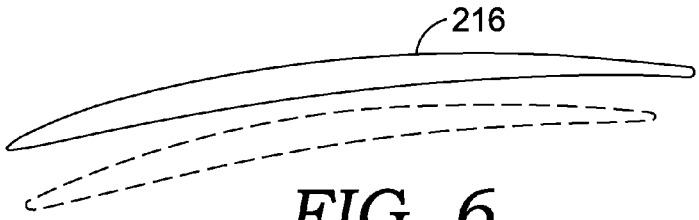
FIG. 6 is a cross section view of the airfoil of the present invention taken towards its tip region compared to a tip cross-section of the prior art airfoil.
Figure 7:
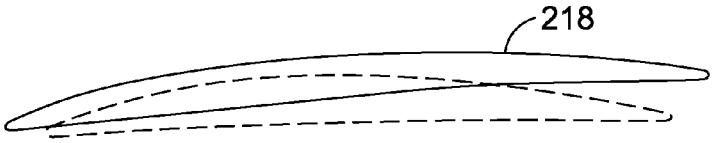
FIG. 7 is a cross section view of the airfoil of the present invention taken towards its mid-span compared to a mid-span section of the prior art airfoil.
Figure 8:
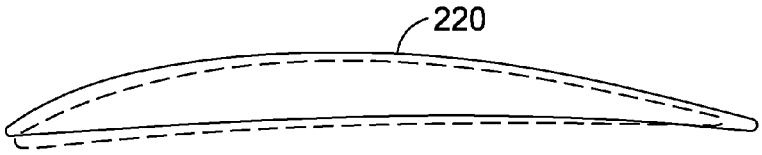
FIG. 8 is a cross section view of the airfoil of the present invention taken towards its base compared to a base section of the prior art airfoil.

The airfoil 202 has an uncoated profile substantially in accordance with Cartesian coordinate values of Table 1, as set forth below, having a set of X, Y, and Z coordinates, where the Y coordinate extends in a radially outward direction from the attachment region. The airfoil 202 is formed by applying smooth continuing splines between the X and Z coordinate values at each Y distance to form an airfoil section. Example airfoil sections 216, 218, and 220 are depicted in FIGS. 6-8. Then, each of the airfoil sections 216, 218, 220, and others not depicted, but described in Table 1, are joined together smoothly to form the profile of the airfoil 202. The coordinate values, which when taken together, generate the profile of airfoil 202 have a plurality of sections of data at spaced intervals in the Y direction that are measured from a datum plane B that is indicative of the center plane along root faces of the attachment 206, as shown in FIGS. 2 and 3. The datum plane B is located a distance of approximately 0.205 inches from the bottom surface of attachment 206. The airfoil 202 extends a radial distance of approximately 3 inches and varies in its longitudinal length and thickness depending on the radial span.

A compressor component for a land-based compressor is typically fabricated from a relatively low temperature alloy since the air temperature of the compressor typically only reaches upwards of 700 deg. F. In an embodiment of the present invention, the compressor component 200 is fabricated from a lower temperature alloy such as a stainless steel alloy. The compressor component 200 can be fabricated by a variety of manufacturing techniques such as forging, casting, milling, and electro-chemical machining (ECM). For example, when milling or electro-chemical machining processes are used, the compressor component 200 is machined from bar stock.

Because of the limited precision of certain manufacturing techniques, the compressor component 200 has manufacturing tolerances for the surface profile of the airfoil 202 that can cause the airfoil 202 to vary by approximately +/−0.008 inches from a nominal state. In addition to manufacturing tolerances affecting the overall position of the airfoil 202, it is also possible to scale the airfoil 202 to a larger or smaller airfoil size, approximately 80%-120% of its present size. However, in order to maintain the benefits of this airfoil shape and size, in terms of stiffness and stress, it is necessary to scale the airfoil uniformly in X and Z directions, but Y direction may be scaled separately.

While an embodiment of the present invention provides an uncoated compressor component 200 such as a compressor blade, it is possible to add a coating to at least a portion of the airfoil 202 in an alternate embodiment. A coating can be applied to the airfoil 202 in order to provide corrosion resistance protection to the material of the airfoil portion. In this embodiment, the coating would preferably be applied approximately 0.001-0.003 inches thick.

Figure 10:
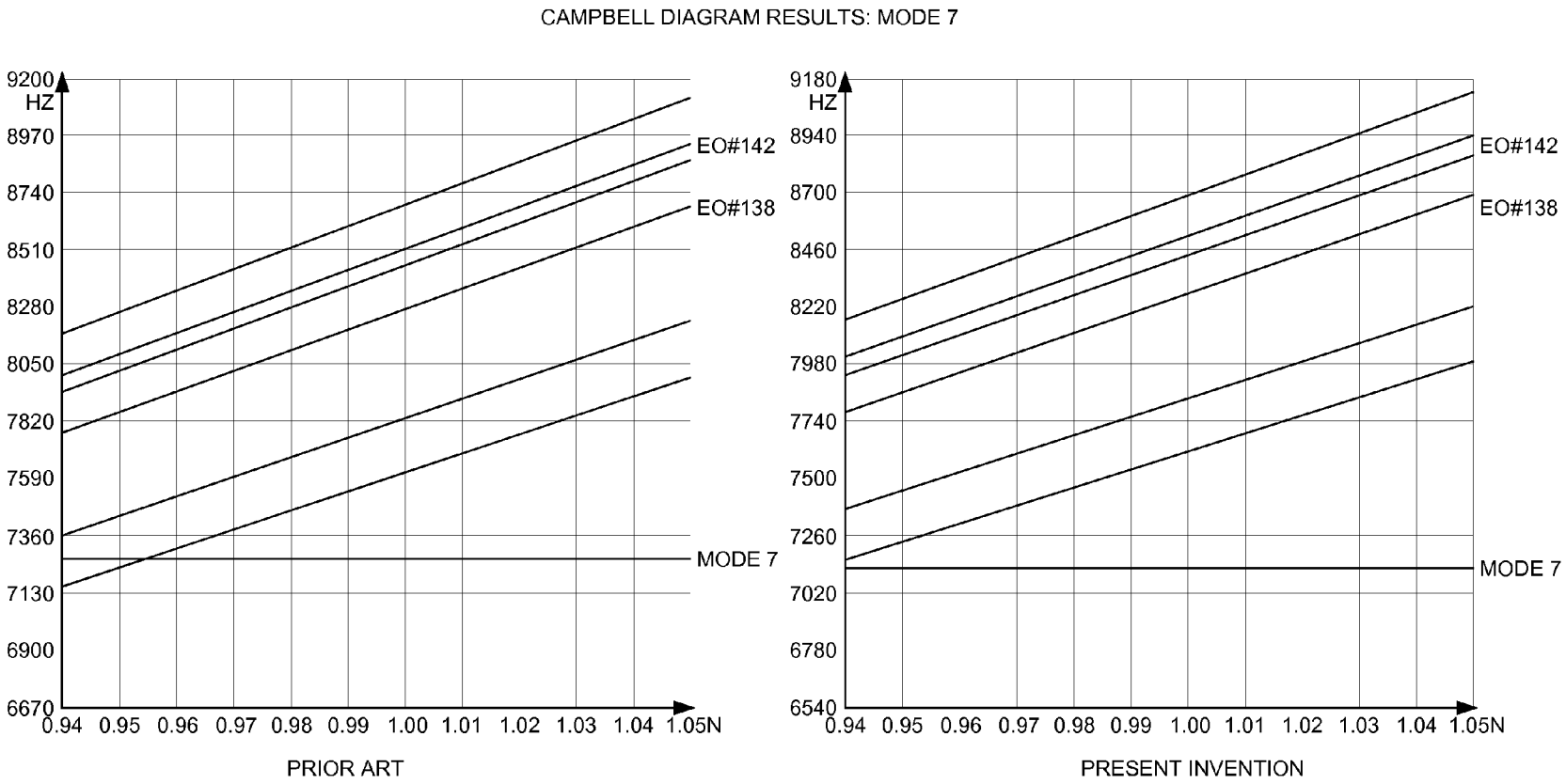
FIG. 10 is a set of Campbell diagrams depicting a comparison of operating frequencies for the prior art component and the present invention.

As one skilled in the art of blade and vane airfoil design will understand, the airfoils move at various modes due to their geometry and the aerodynamic forces being applied thereto. Should this excitation occur for prolonged periods of time at a natural frequency or order thereof, the airfoil 202 can fail due to high cycle fatigue as occurred in the prior art design. Such modes include bending, torsion, and various higher order modes. For example, a critical bending mode for the compressor component of the present invention is the chordwise bending mode initiated by vibrations imparted by upstream vanes (qty. 138) or downstream vanes (qty. 142). Where the seventh bending mode crosses either of these frequency ranges for a particular speed range, this creates an excitement in the blade causing it to cycle and eventually fail in high cycle fatigue. For the prior art airfoil configuration of blade 100, the seventh mode crossed within a tolerance range of the 138 engine order (caused by the upstream vanes), as shown in FIG. 10. This crossing is the root cause for the vibrations that led to failure of a portion of the blade tip and the temporary work around of cropping the blade tip in the prior art configuration. Referring to the plot of frequency versus percent speed for the present invention (compressor component 200), it can be seen that the seventh mode no longer crosses the engine orders of the upstream vane pack (138) or downstream vane pack (142), nor either tolerance range. As such, the present invention is no longer subjected to potentially damaging vibrations associated with the seventh mode and the blade tip will no longer crack due to this excitation.

TABLE 1

| X | Y | Z |
|---|---|---|
| 0.197 | 0.059 | −0.907 |
| 0.170 | 0.059 | −0.841 |
| 0.144 | 0.059 | −0.775 |
| 0.117 | 0.059 | −0.710 |
| 0.092 | 0.059 | −0.646 |
| 0.067 | 0.059 | −0.583 |
| 0.043 | 0.059 | −0.521 |
| 0.021 | 0.059 | −0.461 |
| −0.001 | 0.059 | −0.401 |
| −0.021 | 0.059 | −0.343 |
| −0.039 | 0.059 | −0.286 |
| −0.057 | 0.059 | −0.230 |

TABLE 1-continued

| X | Y | Z |
|---|---|---|
| −0.072 | 0.059 | −0.174 |
| −0.087 | 0.059 | −0.119 |
| −0.099 | 0.059 | −0.064 |
| −0.111 | 0.059 | −0.009 |
| −0.120 | 0.059 | 0.047 |
| −0.128 | 0.059 | 0.103 |
| −0.134 | 0.059 | 0.159 |
| −0.139 | 0.059 | 0.216 |
| −0.141 | 0.059 | 0.275 |
| −0.142 | 0.059 | 0.334 |
| −0.140 | 0.059 | 0.394 |
| −0.137 | 0.059 | 0.455 |
| −0.131 | 0.059 | 0.517 |
| −0.122 | 0.059 | 0.580 |
| −0.111 | 0.059 | 0.644 |
| −0.096 | 0.059 | 0.707 |
| −0.079 | 0.059 | 0.770 |
| −0.058 | 0.059 | 0.832 |
| −0.032 | 0.059 | 0.892 |
| −0.003 | 0.059 | 0.950 |
| 0.032 | 0.059 | 1.005 |
| 0.072 | 0.059 | 1.055 |
| 0.088 | 0.059 | 1.072 |
| 0.090 | 0.059 | 1.074 |
| 0.092 | 0.059 | 1.076 |
| 0.094 | 0.059 | 1.077 |
| 0.097 | 0.059 | 1.078 |
| 0.099 | 0.059 | 1.078 |
| 0.102 | 0.059 | 1.078 |
| 0.105 | 0.059 | 1.077 |
| 0.107 | 0.059 | 1.076 |
| 0.109 | 0.059 | 1.075 |
| 0.111 | 0.059 | 1.073 |
| 0.112 | 0.059 | 1.071 |
| 0.114 | 0.059 | 1.069 |
| 0.114 | 0.059 | 1.066 |
| 0.115 | 0.059 | 1.064 |
| 0.115 | 0.059 | 1.061 |
| 0.114 | 0.059 | 1.058 |
| 0.110 | 0.059 | 1.002 |
| 0.105 | 0.059 | 0.946 |
| 0.100 | 0.059 | 0.890 |
| 0.096 | 0.059 | 0.833 |
| 0.092 | 0.059 | 0.776 |
| 0.088 | 0.059 | 0.718 |
| 0.085 | 0.059 | 0.660 |
| 0.082 | 0.059 | 0.601 |
| 0.080 | 0.059 | 0.542 |
| 0.078 | 0.059 | 0.482 |
| 0.077 | 0.059 | 0.422 |
| 0.077 | 0.059 | 0.361 |
| 0.077 | 0.059 | 0.300 |
| 0.078 | 0.059 | 0.239 |
| 0.079 | 0.059 | 0.177 |
| 0.082 | 0.059 | 0.116 |
| 0.085 | 0.059 | 0.054 |
| 0.089 | 0.059 | −0.007 |
| 0.094 | 0.059 | −0.068 |
| 0.099 | 0.059 | −0.130 |
| 0.106 | 0.059 | −0.190 |
| 0.113 | 0.059 | −0.250 |
| 0.120 | 0.059 | −0.310 |
| 0.129 | 0.059 | −0.370 |
| 0.138 | 0.059 | −0.428 |
| 0.148 | 0.059 | −0.486 |
| 0.158 | 0.059 | −0.544 |
| 0.169 | 0.059 | −0.600 |
| 0.181 | 0.059 | −0.657 |
| 0.192 | 0.059 | −0.712 |
| 0.204 | 0.059 | −0.768 |
| 0.217 | 0.059 | −0.822 |
| 0.229 | 0.059 | −0.877 |
| 0.234 | 0.059 | −0.898 |
| 0.235 | 0.059 | −0.903 |
| 0.235 | 0.059 | −0.907 |
| 0.234 | 0.059 | −0.911 |
| 0.233 | 0.059 | −0.914 |
| 0.231 | 0.059 | −0.918 |

TABLE 1-continued

| X | Y | Z |
|---|---|---|
| 0.228 | 0.059 | −0.920 |
| 0.225 | 0.059 | −0.922 |
| 0.221 | 0.059 | −0.924 |
| 0.217 | 0.059 | −0.924 |
| 0.213 | 0.059 | −0.924 |
| 0.210 | 0.059 | −0.923 |
| 0.206 | 0.059 | −0.921 |
| 0.203 | 0.059 | −0.918 |
| 0.201 | 0.059 | −0.915 |
| 0.199 | 0.059 | −0.911 |
| 0.197 | 0.059 | −0.907 |
| 0.129 | 0.322 | −0.914 |
| 0.107 | 0.322 | −0.848 |
| 0.085 | 0.322 | −0.783 |
| 0.063 | 0.322 | −0.718 |
| 0.043 | 0.322 | −0.653 |
| 0.022 | 0.322 | −0.590 |
| 0.003 | 0.322 | −0.527 |
| −0.015 | 0.322 | −0.465 |
| −0.032 | 0.322 | −0.403 |
| −0.048 | 0.322 | −0.343 |
| −0.063 | 0.322 | −0.283 |
| −0.076 | 0.322 | −0.224 |
| −0.088 | 0.322 | −0.165 |
| −0.099 | 0.322 | −0.106 |
| −0.108 | 0.322 | −0.048 |
| −0.116 | 0.322 | 0.010 |
| −0.123 | 0.322 | 0.069 |
| −0.128 | 0.322 | 0.127 |
| −0.132 | 0.322 | 0.186 |
| −0.134 | 0.322 | 0.245 |
| −0.134 | 0.322 | 0.304 |
| −0.133 | 0.322 | 0.364 |
| −0.130 | 0.322 | 0.424 |
| −0.126 | 0.322 | 0.484 |
| −0.119 | 0.322 | 0.545 |
| −0.110 | 0.322 | 0.606 |
| −0.099 | 0.322 | 0.667 |
| −0.086 | 0.322 | 0.727 |
| −0.069 | 0.322 | 0.787 |
| −0.050 | 0.322 | 0.846 |
| −0.028 | 0.322 | 0.903 |
| −0.001 | 0.322 | 0.958 |
| 0.029 | 0.322 | 1.011 |
| 0.064 | 0.322 | 1.060 |
| 0.078 | 0.322 | 1.077 |
| 0.080 | 0.322 | 1.080 |
| 0.083 | 0.322 | 1.082 |
| 0.085 | 0.322 | 1.084 |
| 0.088 | 0.322 | 1.085 |
| 0.091 | 0.322 | 1.085 |
| 0.093 | 0.322 | 1.086 |
| 0.096 | 0.322 | 1.085 |
| 0.098 | 0.322 | 1.084 |
| 0.101 | 0.322 | 1.083 |
| 0.102 | 0.322 | 1.081 |
| 0.104 | 0.322 | 1.079 |
| 0.105 | 0.322 | 1.076 |
| 0.106 | 0.322 | 1.073 |
| 0.106 | 0.322 | 1.070 |
| 0.106 | 0.322 | 1.067 |
| 0.106 | 0.322 | 1.064 |
| 0.102 | 0.322 | 1.007 |
| 0.098 | 0.322 | 0.951 |
| 0.094 | 0.322 | 0.895 |
| 0.090 | 0.322 | 0.838 |
| 0.086 | 0.322 | 0.780 |
| 0.082 | 0.322 | 0.722 |
| 0.079 | 0.322 | 0.664 |
| 0.076 | 0.322 | 0.605 |
| 0.073 | 0.322 | 0.545 |
| 0.071 | 0.322 | 0.485 |
| 0.069 | 0.322 | 0.424 |
| 0.067 | 0.322 | 0.364 |
| 0.066 | 0.322 | 0.302 |
| 0.065 | 0.322 | 0.241 |
| 0.065 | 0.322 | 0.179 |
| 0.065 | 0.322 | 0.117 |

TABLE 1-continued

| X | Y | Z |
|---|---|---|
| 0.066 | 0.322 | 0.055 |
| 0.067 | 0.322 | −0.007 |
| 0.070 | 0.322 | −0.068 |
| 0.072 | 0.322 | −0.130 |
| 0.076 | 0.322 | −0.191 |
| 0.080 | 0.322 | −0.252 |
| 0.085 | 0.322 | −0.312 |
| 0.090 | 0.322 | −0.372 |
| 0.096 | 0.322 | −0.431 |
| 0.103 | 0.322 | −0.490 |
| 0.110 | 0.322 | −0.548 |
| 0.117 | 0.322 | −0.606 |
| 0.125 | 0.322 | −0.663 |
| 0.134 | 0.322 | −0.720 |
| 0.143 | 0.322 | −0.776 |
| 0.152 | 0.322 | −0.831 |
| 0.161 | 0.322 | −0.887 |
| 0.164 | 0.322 | −0.908 |
| 0.165 | 0.322 | −0.912 |
| 0.165 | 0.322 | −0.916 |
| 0.164 | 0.322 | −0.920 |
| 0.162 | 0.322 | −0.924 |
| 0.160 | 0.322 | −0.926 |
| 0.158 | 0.322 | −0.929 |
| 0.154 | 0.322 | −0.931 |
| 0.151 | 0.322 | −0.932 |
| 0.147 | 0.322 | −0.932 |
| 0.143 | 0.322 | −0.931 |
| 0.140 | 0.322 | −0.930 |
| 0.137 | 0.322 | −0.928 |
| 0.134 | 0.322 | −0.925 |
| 0.132 | 0.322 | −0.922 |
| 0.131 | 0.322 | −0.918 |
| 0.129 | 0.322 | −0.914 |
| 0.013 | 0.847 | −0.910 |
| −0.001 | 0.847 | −0.846 |
| −0.016 | 0.847 | −0.782 |
| −0.030 | 0.847 | −0.718 |
| −0.043 | 0.847 | −0.655 |
| −0.056 | 0.847 | −0.591 |
| −0.068 | 0.847 | −0.527 |
| −0.079 | 0.847 | −0.464 |
| −0.089 | 0.847 | −0.400 |
| −0.098 | 0.847 | −0.337 |
| −0.106 | 0.847 | −0.274 |
| −0.113 | 0.847 | −0.211 |
| −0.119 | 0.847 | −0.148 |
| −0.124 | 0.847 | −0.086 |
| −0.128 | 0.847 | −0.023 |
| −0.130 | 0.847 | 0.039 |
| −0.132 | 0.847 | 0.101 |
| −0.132 | 0.847 | 0.162 |
| −0.132 | 0.847 | 0.224 |
| −0.130 | 0.847 | 0.285 |
| −0.127 | 0.847 | 0.346 |
| −0.123 | 0.847 | 0.406 |
| −0.118 | 0.847 | 0.466 |
| −0.111 | 0.847 | 0.526 |
| −0.103 | 0.847 | 0.585 |
| −0.094 | 0.847 | 0.643 |
| −0.083 | 0.847 | 0.700 |
| −0.071 | 0.847 | 0.756 |
| −0.056 | 0.847 | 0.812 |
| −0.040 | 0.847 | 0.866 |
| −0.021 | 0.847 | 0.919 |
| 0.000 | 0.847 | 0.970 |
| 0.024 | 0.847 | 1.019 |
| 0.051 | 0.847 | 1.066 |
| 0.062 | 0.847 | 1.084 |
| 0.065 | 0.847 | 1.087 |
| 0.068 | 0.847 | 1.090 |
| 0.070 | 0.847 | 1.093 |
| 0.073 | 0.847 | 1.095 |
| 0.076 | 0.847 | 1.096 |
| 0.079 | 0.847 | 1.097 |
| 0.081 | 0.847 | 1.097 |
| 0.084 | 0.847 | 1.096 |
| 0.086 | 0.847 | 1.094 |

TABLE 1-continued

| X | Y | Z |
|---|---|---|
| 0.088 | 0.847 | 1.092 |
| 0.089 | 0.847 | 1.090 |
| 0.091 | 0.847 | 1.087 |
| 0.091 | 0.847 | 1.083 |
| 0.092 | 0.847 | 1.079 |
| 0.091 | 0.847 | 1.075 |
| 0.091 | 0.847 | 1.071 |
| 0.088 | 0.847 | 1.015 |
| 0.084 | 0.847 | 0.958 |
| 0.080 | 0.847 | 0.901 |
| 0.077 | 0.847 | 0.844 |
| 0.073 | 0.847 | 0.787 |
| 0.069 | 0.847 | 0.729 |
| 0.065 | 0.847 | 0.670 |
| 0.061 | 0.847 | 0.611 |
| 0.057 | 0.847 | 0.552 |
| 0.053 | 0.847 | 0.491 |
| 0.049 | 0.847 | 0.431 |
| 0.045 | 0.847 | 0.370 |
| 0.041 | 0.847 | 0.309 |
| 0.038 | 0.847 | 0.247 |
| 0.035 | 0.847 | 0.185 |
| 0.032 | 0.847 | 0.124 |
| 0.029 | 0.847 | 0.062 |
| 0.026 | 0.847 | 0.000 |
| 0.024 | 0.847 | −0.062 |
| 0.023 | 0.847 | −0.124 |
| 0.022 | 0.847 | −0.185 |
| 0.021 | 0.847 | −0.246 |
| 0.021 | 0.847 | −0.307 |
| 0.021 | 0.847 | −0.367 |
| 0.022 | 0.847 | −0.426 |
| 0.023 | 0.847 | −0.486 |
| 0.025 | 0.847 | −0.544 |
| 0.028 | 0.847 | −0.602 |
| 0.030 | 0.847 | −0.660 |
| 0.033 | 0.847 | −0.717 |
| 0.037 | 0.847 | −0.774 |
| 0.040 | 0.847 | −0.830 |
| 0.044 | 0.847 | −0.887 |
| 0.045 | 0.847 | −0.908 |
| 0.045 | 0.847 | −0.912 |
| 0.045 | 0.847 | −0.915 |
| 0.044 | 0.847 | −0.919 |
| 0.042 | 0.847 | −0.922 |
| 0.040 | 0.847 | −0.924 |
| 0.038 | 0.847 | −0.926 |
| 0.034 | 0.847 | −0.927 |
| 0.031 | 0.847 | −0.928 |
| 0.028 | 0.847 | −0.928 |
| 0.025 | 0.847 | −0.927 |
| 0.022 | 0.847 | −0.925 |
| 0.019 | 0.847 | −0.923 |
| 0.017 | 0.847 | −0.921 |
| 0.015 | 0.847 | −0.917 |
| 0.014 | 0.847 | −0.914 |
| 0.013 | 0.847 | −0.910 |
| −0.069 | 1.372 | −0.887 |
| −0.078 | 1.372 | −0.826 |
| −0.088 | 1.372 | −0.765 |
| −0.097 | 1.372 | −0.703 |
| −0.105 | 1.372 | −0.642 |
| −0.113 | 1.372 | −0.579 |
| −0.120 | 1.372 | −0.517 |
| −0.127 | 1.372 | −0.454 |
| −0.133 | 1.372 | −0.391 |
| −0.137 | 1.372 | −0.328 |
| −0.141 | 1.372 | −0.264 |
| −0.144 | 1.372 | −0.200 |
| −0.146 | 1.372 | −0.136 |
| −0.147 | 1.372 | −0.072 |
| −0.147 | 1.372 | −0.008 |
| −0.146 | 1.372 | 0.056 |
| −0.145 | 1.372 | 0.119 |
| −0.142 | 1.372 | 0.182 |
| −0.139 | 1.372 | 0.245 |
| −0.134 | 1.372 | 0.307 |
| −0.129 | 1.372 | 0.368 |

TABLE 1-continued

| X | Y | Z |
|---|---|---|
| −0.123 | 1.372 | 0.429 |
| −0.116 | 1.372 | 0.488 |
| −0.109 | 1.372 | 0.547 |
| −0.100 | 1.372 | 0.605 |
| −0.090 | 1.372 | 0.661 |
| −0.080 | 1.372 | 0.716 |
| −0.068 | 1.372 | 0.770 |
| −0.055 | 1.372 | 0.823 |
| −0.040 | 1.372 | 0.874 |
| −0.024 | 1.372 | 0.924 |
| −0.007 | 1.372 | 0.972 |
| 0.013 | 1.372 | 1.019 |
| 0.035 | 1.372 | 1.064 |
| 0.045 | 1.372 | 1.082 |
| 0.047 | 1.372 | 1.086 |
| 0.050 | 1.372 | 1.090 |
| 0.052 | 1.372 | 1.093 |
| 0.055 | 1.372 | 1.096 |
| 0.058 | 1.372 | 1.097 |
| 0.061 | 1.372 | 1.098 |
| 0.064 | 1.372 | 1.099 |
| 0.066 | 1.372 | 1.098 |
| 0.069 | 1.372 | 1.097 |
| 0.071 | 1.372 | 1.094 |
| 0.072 | 1.372 | 1.092 |
| 0.073 | 1.372 | 1.088 |
| 0.074 | 1.372 | 1.084 |
| 0.074 | 1.372 | 1.079 |
| 0.074 | 1.372 | 1.074 |
| 0.074 | 1.372 | 1.069 |
| 0.069 | 1.372 | 1.014 |
| 0.065 | 1.372 | 0.958 |
| 0.061 | 1.372 | 0.902 |
| 0.056 | 1.372 | 0.845 |
| 0.052 | 1.372 | 0.788 |
| 0.047 | 1.372 | 0.731 |
| 0.042 | 1.372 | 0.673 |
| 0.037 | 1.372 | 0.614 |
| 0.032 | 1.372 | 0.556 |
| 0.026 | 1.372 | 0.496 |
| 0.021 | 1.372 | 0.436 |
| 0.016 | 1.372 | 0.376 |
| 0.011 | 1.372 | 0.316 |
| 0.006 | 1.372 | 0.255 |
| 0.000 | 1.372 | 0.194 |
| −0.004 | 1.372 | 0.133 |
| −0.009 | 1.372 | 0.072 |
| −0.014 | 1.372 | 0.010 |
| −0.018 | 1.372 | −0.051 |
| −0.022 | 1.372 | −0.111 |
| −0.025 | 1.372 | −0.172 |
| −0.029 | 1.372 | −0.232 |
| −0.032 | 1.372 | −0.292 |
| −0.034 | 1.372 | −0.352 |
| −0.036 | 1.372 | −0.411 |
| −0.038 | 1.372 | −0.469 |
| −0.039 | 1.372 | −0.527 |
| −0.039 | 1.372 | −0.585 |
| −0.040 | 1.372 | −0.642 |
| −0.040 | 1.372 | −0.698 |
| −0.040 | 1.372 | −0.755 |
| −0.040 | 1.372 | −0.811 |
| −0.039 | 1.372 | −0.866 |
| −0.039 | 1.372 | −0.887 |
| −0.039 | 1.372 | −0.891 |
| −0.040 | 1.372 | −0.894 |
| −0.041 | 1.372 | −0.897 |
| −0.042 | 1.372 | −0.899 |
| −0.045 | 1.372 | −0.902 |
| −0.047 | 1.372 | −0.903 |
| −0.050 | 1.372 | −0.904 |
| −0.053 | 1.372 | −0.905 |
| −0.056 | 1.372 | −0.904 |
| −0.059 | 1.372 | −0.903 |
| −0.062 | 1.372 | −0.902 |
| −0.064 | 1.372 | −0.900 |
| −0.066 | 1.372 | −0.897 |
| −0.067 | 1.372 | −0.894 |

TABLE 1-continued

| X | Y | Z |
|---|---|---|
| −0.068 | 1.372 | −0.891 |
| −0.069 | 1.372 | −0.887 |
| −0.121 | 1.897 | −0.858 |
| −0.128 | 1.897 | −0.800 |
| −0.134 | 1.897 | −0.741 |
| −0.141 | 1.897 | −0.683 |
| −0.147 | 1.897 | −0.624 |
| −0.152 | 1.897 | −0.564 |
| −0.157 | 1.897 | −0.504 |
| −0.161 | 1.897 | −0.443 |
| −0.164 | 1.897 | −0.381 |
| −0.166 | 1.897 | −0.319 |
| −0.168 | 1.897 | −0.256 |
| −0.168 | 1.897 | −0.193 |
| −0.168 | 1.897 | −0.130 |
| −0.167 | 1.897 | −0.066 |
| −0.165 | 1.897 | −0.003 |
| −0.163 | 1.897 | 0.061 |
| −0.159 | 1.897 | 0.124 |
| −0.155 | 1.897 | 0.187 |
| −0.150 | 1.897 | 0.250 |
| −0.145 | 1.897 | 0.312 |
| −0.138 | 1.897 | 0.373 |
| −0.132 | 1.897 | 0.433 |
| −0.124 | 1.897 | 0.492 |
| −0.116 | 1.897 | 0.550 |
| −0.107 | 1.897 | 0.606 |
| −0.097 | 1.897 | 0.662 |
| −0.086 | 1.897 | 0.715 |
| −0.075 | 1.897 | 0.768 |
| −0.063 | 1.897 | 0.818 |
| −0.049 | 1.897 | 0.867 |
| −0.035 | 1.897 | 0.915 |
| −0.019 | 1.897 | 0.961 |
| −0.002 | 1.897 | 1.006 |
| 0.017 | 1.897 | 1.050 |
| 0.025 | 1.897 | 1.068 |
| 0.028 | 1.897 | 1.073 |
| 0.030 | 1.897 | 1.077 |
| 0.033 | 1.897 | 1.081 |
| 0.036 | 1.897 | 1.084 |
| 0.039 | 1.897 | 1.086 |
| 0.042 | 1.897 | 1.088 |
| 0.045 | 1.897 | 1.088 |
| 0.047 | 1.897 | 1.087 |
| 0.050 | 1.897 | 1.086 |
| 0.052 | 1.897 | 1.083 |
| 0.053 | 1.897 | 1.080 |
| 0.054 | 1.897 | 1.076 |
| 0.055 | 1.897 | 1.072 |
| 0.055 | 1.897 | 1.067 |
| 0.055 | 1.897 | 1.061 |
| 0.054 | 1.897 | 1.056 |
| 0.048 | 1.897 | 1.001 |
| 0.042 | 1.897 | 0.947 |
| 0.036 | 1.897 | 0.892 |
| 0.031 | 1.897 | 0.836 |
| 0.025 | 1.897 | 0.781 |
| 0.018 | 1.897 | 0.725 |
| 0.012 | 1.897 | 0.668 |
| 0.006 | 1.897 | 0.611 |
| 0.000 | 1.897 | 0.553 |
| −0.006 | 1.897 | 0.495 |
| −0.013 | 1.897 | 0.437 |
| −0.019 | 1.897 | 0.378 |
| −0.025 | 1.897 | 0.319 |
| −0.031 | 1.897 | 0.259 |
| −0.037 | 1.897 | 0.200 |
| −0.043 | 1.897 | 0.140 |
| −0.048 | 1.897 | 0.080 |
| −0.053 | 1.897 | 0.020 |
| −0.058 | 1.897 | −0.040 |
| −0.063 | 1.897 | −0.099 |
| −0.067 | 1.897 | −0.159 |
| −0.071 | 1.897 | −0.218 |
| −0.075 | 1.897 | −0.276 |
| −0.078 | 1.897 | −0.334 |
| −0.081 | 1.897 | −0.392 |

TABLE 1-continued

| X | Y | Z |
|---|---|---|
| −0.084 | 1.897 | −0.449 |
| −0.086 | 1.897 | −0.506 |
| −0.088 | 1.897 | −0.562 |
| −0.089 | 1.897 | −0.618 |
| −0.090 | 1.897 | −0.674 |
| −0.091 | 1.897 | −0.729 |
| −0.092 | 1.897 | −0.784 |
| −0.093 | 1.897 | −0.838 |
| −0.093 | 1.897 | −0.858 |
| −0.093 | 1.897 | −0.862 |
| −0.094 | 1.897 | −0.865 |
| −0.095 | 1.897 | −0.868 |
| −0.097 | 1.897 | −0.870 |
| −0.099 | 1.897 | −0.872 |
| −0.101 | 1.897 | −0.873 |
| −0.104 | 1.897 | −0.874 |
| −0.107 | 1.897 | −0.874 |
| −0.110 | 1.897 | −0.874 |
| −0.113 | 1.897 | −0.873 |
| −0.115 | 1.897 | −0.872 |
| −0.117 | 1.897 | −0.870 |
| −0.119 | 1.897 | −0.867 |
| −0.120 | 1.897 | −0.864 |
| −0.120 | 1.897 | −0.861 |
| −0.121 | 1.897 | −0.858 |
| −0.161 | 2.422 | −0.835 |
| −0.167 | 2.422 | −0.780 |
| −0.173 | 2.422 | −0.725 |
| −0.178 | 2.422 | −0.669 |
| −0.183 | 2.422 | −0.612 |
| −0.188 | 2.422 | −0.555 |
| −0.192 | 2.422 | −0.497 |
| −0.195 | 2.422 | −0.439 |
| −0.197 | 2.422 | −0.379 |
| −0.198 | 2.422 | −0.319 |
| −0.198 | 2.422 | −0.258 |
| −0.198 | 2.422 | −0.196 |
| −0.197 | 2.422 | −0.134 |
| −0.194 | 2.422 | −0.072 |
| −0.191 | 2.422 | −0.009 |
| −0.188 | 2.422 | 0.053 |
| −0.183 | 2.422 | 0.116 |
| −0.177 | 2.422 | 0.178 |
| −0.171 | 2.422 | 0.240 |
| −0.164 | 2.422 | 0.301 |
| −0.157 | 2.422 | 0.362 |
| −0.149 | 2.422 | 0.421 |
| −0.140 | 2.422 | 0.480 |
| −0.131 | 2.422 | 0.537 |
| −0.121 | 2.422 | 0.593 |
| −0.110 | 2.422 | 0.647 |
| −0.099 | 2.422 | 0.700 |
| −0.087 | 2.422 | 0.751 |
| −0.074 | 2.422 | 0.801 |
| −0.061 | 2.422 | 0.850 |
| −0.046 | 2.422 | 0.896 |
| −0.031 | 2.422 | 0.942 |
| −0.014 | 2.422 | 0.986 |
| 0.004 | 2.422 | 1.029 |
| 0.013 | 2.422 | 1.047 |
| 0.015 | 2.422 | 1.052 |
| 0.018 | 2.422 | 1.057 |
| 0.021 | 2.422 | 1.061 |
| 0.024 | 2.422 | 1.064 |
| 0.027 | 2.422 | 1.066 |
| 0.030 | 2.422 | 1.068 |
| 0.032 | 2.422 | 1.068 |
| 0.035 | 2.422 | 1.068 |
| 0.037 | 2.422 | 1.066 |
| 0.039 | 2.422 | 1.064 |
| 0.041 | 2.422 | 1.060 |
| 0.041 | 2.422 | 1.056 |
| 0.042 | 2.422 | 1.051 |
| 0.042 | 2.422 | 1.046 |
| 0.041 | 2.422 | 1.040 |
| 0.040 | 2.422 | 1.035 |
| 0.033 | 2.422 | 0.982 |
| 0.025 | 2.422 | 0.928 |

TABLE 1-continued

| X | Y | Z |
|---|---|---|
| 0.018 | 2.422 | 0.875 |
| 0.010 | 2.422 | 0.821 |
| 0.002 | 2.422 | 0.767 |
| −0.006 | 2.422 | 0.712 |
| −0.013 | 2.422 | 0.657 |
| −0.021 | 2.422 | 0.601 |
| −0.029 | 2.422 | 0.545 |
| −0.037 | 2.422 | 0.488 |
| −0.045 | 2.422 | 0.431 |
| −0.052 | 2.422 | 0.374 |
| −0.060 | 2.422 | 0.316 |
| −0.067 | 2.422 | 0.258 |
| −0.074 | 2.422 | 0.199 |
| −0.081 | 2.422 | 0.141 |
| −0.087 | 2.422 | 0.082 |
| −0.094 | 2.422 | 0.024 |
| −0.099 | 2.422 | −0.034 |
| −0.105 | 2.422 | −0.093 |
| −0.110 | 2.422 | −0.151 |
| −0.114 | 2.422 | −0.208 |
| −0.118 | 2.422 | −0.266 |
| −0.122 | 2.422 | −0.323 |
| −0.125 | 2.422 | −0.379 |
| −0.127 | 2.422 | −0.435 |
| −0.130 | 2.422 | −0.491 |
| −0.131 | 2.422 | −0.546 |
| −0.132 | 2.422 | −0.600 |
| −0.133 | 2.422 | −0.655 |
| −0.134 | 2.422 | −0.709 |
| −0.134 | 2.422 | −0.762 |
| −0.134 | 2.422 | −0.816 |
| −0.134 | 2.422 | −0.836 |
| −0.135 | 2.422 | −0.839 |
| −0.135 | 2.422 | −0.842 |
| −0.136 | 2.422 | −0.844 |
| −0.138 | 2.422 | −0.847 |
| −0.140 | 2.422 | −0.849 |
| −0.142 | 2.422 | −0.850 |
| −0.145 | 2.422 | −0.851 |
| −0.148 | 2.422 | −0.851 |
| −0.151 | 2.422 | −0.851 |
| −0.153 | 2.422 | −0.850 |
| −0.155 | 2.422 | −0.848 |
| −0.157 | 2.422 | −0.846 |
| −0.159 | 2.422 | −0.844 |
| −0.160 | 2.422 | −0.841 |
| −0.161 | 2.422 | −0.838 |
| −0.161 | 2.422 | −0.835 |
| −0.198 | 2.947 | −0.820 |
| −0.204 | 2.947 | −0.768 |
| −0.209 | 2.947 | −0.716 |
| −0.215 | 2.947 | −0.664 |
| −0.219 | 2.947 | −0.611 |
| −0.223 | 2.947 | −0.557 |
| −0.227 | 2.947 | −0.502 |
| −0.229 | 2.947 | −0.447 |
| −0.231 | 2.947 | −0.390 |
| −0.232 | 2.947 | −0.332 |
| −0.233 | 2.947 | −0.274 |
| −0.232 | 2.947 | −0.215 |
| −0.230 | 2.947 | −0.155 |
| −0.228 | 2.947 | −0.094 |
| −0.225 | 2.947 | −0.034 |
| −0.220 | 2.947 | 0.027 |
| −0.215 | 2.947 | 0.089 |
| −0.210 | 2.947 | 0.150 |
| −0.203 | 2.947 | 0.211 |
| −0.195 | 2.947 | 0.271 |
| −0.187 | 2.947 | 0.331 |
| −0.178 | 2.947 | 0.390 |
| −0.169 | 2.947 | 0.448 |
| −0.158 | 2.947 | 0.505 |
| −0.147 | 2.947 | 0.561 |
| −0.135 | 2.947 | 0.615 |
| −0.123 | 2.947 | 0.668 |
| −0.109 | 2.947 | 0.719 |
| −0.095 | 2.947 | 0.769 |
| −0.080 | 2.947 | 0.818 |

TABLE 1-continued

| X | Y | Z |
|---|---|---|
| −0.064 | 2.947 | 0.865 |
| −0.047 | 2.947 | 0.910 |
| −0.028 | 2.947 | 0.954 |
| −0.008 | 2.947 | 0.998 |
| 0.000 | 2.947 | 1.015 |
| 0.003 | 2.947 | 1.020 |
| 0.006 | 2.947 | 1.025 |
| 0.009 | 2.947 | 1.029 |
| 0.012 | 2.947 | 1.032 |
| 0.015 | 2.947 | 1.034 |
| 0.017 | 2.947 | 1.036 |
| 0.020 | 2.947 | 1.036 |
| 0.023 | 2.947 | 1.035 |
| 0.025 | 2.947 | 1.034 |
| 0.026 | 2.947 | 1.031 |
| 0.027 | 2.947 | 1.028 |
| 0.028 | 2.947 | 1.024 |
| 0.028 | 2.947 | 1.019 |
| 0.028 | 2.947 | 1.014 |
| 0.027 | 2.947 | 1.008 |
| 0.026 | 2.947 | 1.003 |
| 0.017 | 2.947 | 0.951 |
| 0.008 | 2.947 | 0.899 |
| −0.002 | 2.947 | 0.847 |
| −0.011 | 2.947 | 0.795 |
| −0.021 | 2.947 | 0.742 |
| −0.030 | 2.947 | 0.689 |
| −0.040 | 2.947 | 0.635 |
| −0.049 | 2.947 | 0.581 |
| −0.059 | 2.947 | 0.526 |
| −0.068 | 2.947 | 0.471 |
| −0.077 | 2.947 | 0.416 |
| −0.086 | 2.947 | 0.360 |
| −0.095 | 2.947 | 0.303 |
| −0.104 | 2.947 | 0.247 |
| −0.112 | 2.947 | 0.190 |
| −0.120 | 2.947 | 0.133 |
| −0.127 | 2.947 | 0.076 |
| −0.134 | 2.947 | 0.019 |
| −0.141 | 2.947 | −0.038 |
| −0.147 | 2.947 | −0.095 |
| −0.152 | 2.947 | −0.152 |
| −0.157 | 2.947 | −0.208 |
| −0.161 | 2.947 | −0.264 |
| −0.165 | 2.947 | −0.319 |
| −0.168 | 2.947 | −0.375 |
| −0.170 | 2.947 | −0.429 |
| −0.172 | 2.947 | −0.484 |
| −0.173 | 2.947 | −0.537 |
| −0.173 | 2.947 | −0.591 |
| −0.174 | 2.947 | −0.644 |
| −0.173 | 2.947 | −0.696 |
| −0.173 | 2.947 | −0.749 |
| −0.172 | 2.947 | −0.801 |
| −0.172 | 2.947 | −0.820 |
| −0.172 | 2.947 | −0.823 |
| −0.173 | 2.947 | −0.826 |
| −0.174 | 2.947 | −0.829 |
| −0.175 | 2.947 | −0.831 |
| −0.177 | 2.947 | −0.833 |
| −0.180 | 2.947 | −0.834 |
| −0.182 | 2.947 | −0.835 |
| −0.185 | 2.947 | −0.836 |
| −0.188 | 2.947 | −0.835 |
| −0.191 | 2.947 | −0.834 |
| −0.193 | 2.947 | −0.833 |
| −0.195 | 2.947 | −0.831 |
| −0.196 | 2.947 | −0.829 |
| −0.197 | 2.947 | −0.826 |
| −0.198 | 2.947 | −0.823 |
| −0.198 | 2.947 | −0.820 |
| −0.186 | 3.471 | −0.759 |
| −0.191 | 3.471 | −0.708 |
| −0.197 | 3.471 | −0.658 |
| −0.202 | 3.471 | −0.606 |
| −0.207 | 3.471 | −0.555 |
| −0.212 | 3.471 | −0.503 |
| −0.216 | 3.471 | −0.450 |

TABLE 1-continued

| X | Y | Z |
|---|---|---|
| −0.220 | 3.471 | −0.397 |
| −0.224 | 3.471 | −0.343 |
| −0.226 | 3.471 | −0.288 |
| −0.229 | 3.471 | −0.233 |
| −0.230 | 3.471 | −0.177 |
| −0.231 | 3.471 | −0.121 |
| −0.231 | 3.471 | −0.065 |
| −0.230 | 3.471 | −0.008 |
| −0.228 | 3.471 | 0.048 |
| −0.226 | 3.471 | 0.105 |
| −0.222 | 3.471 | 0.162 |
| −0.218 | 3.471 | 0.219 |
| −0.213 | 3.471 | 0.275 |
| −0.206 | 3.471 | 0.331 |
| −0.199 | 3.471 | 0.386 |
| −0.191 | 3.471 | 0.441 |
| −0.181 | 3.471 | 0.495 |
| −0.171 | 3.471 | 0.548 |
| −0.159 | 3.471 | 0.600 |
| −0.146 | 3.471 | 0.651 |
| −0.132 | 3.471 | 0.701 |
| −0.116 | 3.471 | 0.749 |
| −0.099 | 3.471 | 0.797 |
| −0.081 | 3.471 | 0.843 |
| −0.061 | 3.471 | 0.888 |
| −0.040 | 3.471 | 0.932 |
| −0.017 | 3.471 | 0.974 |
| −0.007 | 3.471 | 0.991 |
| −0.005 | 3.471 | 0.996 |
| −0.002 | 3.471 | 1.000 |
| 0.001 | 3.471 | 1.003 |
| 0.004 | 3.471 | 1.006 |
| 0.007 | 3.471 | 1.009 |
| 0.010 | 3.471 | 1.010 |
| 0.013 | 3.471 | 1.010 |
| 0.015 | 3.471 | 1.009 |
| 0.017 | 3.471 | 1.008 |
| 0.018 | 3.471 | 1.005 |
| 0.019 | 3.471 | 1.002 |
| 0.019 | 3.471 | 0.998 |
| 0.019 | 3.471 | 0.993 |
| 0.018 | 3.471 | 0.988 |
| 0.017 | 3.471 | 0.983 |
| 0.016 | 3.471 | 0.978 |
| 0.004 | 3.471 | 0.930 |
| −0.009 | 3.471 | 0.881 |
| −0.020 | 3.471 | 0.832 |
| −0.032 | 3.471 | 0.783 |
| −0.044 | 3.471 | 0.734 |
| −0.055 | 3.471 | 0.683 |
| −0.065 | 3.471 | 0.633 |
| −0.076 | 3.471 | 0.581 |
| −0.085 | 3.471 | 0.530 |
| −0.095 | 3.471 | 0.477 |
| −0.103 | 3.471 | 0.424 |
| −0.111 | 3.471 | 0.371 |
| −0.119 | 3.471 | 0.317 |
| −0.126 | 3.471 | 0.263 |
| −0.132 | 3.471 | 0.209 |
| −0.138 | 3.471 | 0.154 |
| −0.143 | 3.471 | 0.100 |
| −0.148 | 3.471 | 0.045 |
| −0.152 | 3.471 | −0.010 |
| −0.155 | 3.471 | −0.064 |
| −0.158 | 3.471 | −0.119 |
| −0.160 | 3.471 | −0.173 |
| −0.162 | 3.471 | −0.226 |
| −0.163 | 3.471 | −0.280 |
| −0.164 | 3.471 | −0.333 |
| −0.164 | 3.471 | −0.385 |
| −0.164 | 3.471 | −0.437 |
| −0.164 | 3.471 | −0.489 |
| −0.164 | 3.471 | −0.540 |
| −0.163 | 3.471 | −0.591 |
| −0.162 | 3.471 | −0.641 |
| −0.161 | 3.471 | −0.691 |
| −0.159 | 3.471 | −0.741 |
| −0.159 | 3.471 | −0.759 |

TABLE 1-continued

| X | Y | Z |
|---|---|---|
| −0.159 | 3.471 | −0.763 |
| −0.159 | 3.471 | −0.766 |
| −0.160 | 3.471 | −0.768 |
| −0.162 | 3.471 | −0.771 |
| −0.164 | 3.471 | −0.773 |
| −0.166 | 3.471 | −0.774 |
| −0.169 | 3.471 | −0.775 |
| −0.172 | 3.471 | −0.775 |
| −0.175 | 3.471 | −0.775 |
| −0.178 | 3.471 | −0.774 |
| −0.180 | 3.471 | −0.773 |
| −0.182 | 3.471 | −0.771 |
| −0.183 | 3.471 | −0.768 |
| −0.184 | 3.471 | −0.765 |
| −0.185 | 3.471 | −0.762 |
| −0.186 | 3.471 | −0.759 |
| −0.167 | 3.734 | −0.709 |
| −0.173 | 3.734 | −0.657 |
| −0.179 | 3.734 | −0.605 |
| −0.185 | 3.734 | −0.553 |
| −0.190 | 3.734 | −0.501 |
| −0.196 | 3.734 | −0.449 |
| −0.202 | 3.734 | −0.396 |
| −0.207 | 3.734 | −0.344 |
| −0.212 | 3.734 | −0.291 |
| −0.217 | 3.734 | −0.238 |
| −0.221 | 3.734 | −0.185 |
| −0.225 | 3.734 | −0.132 |
| −0.228 | 3.734 | −0.079 |
| −0.230 | 3.734 | −0.026 |
| −0.232 | 3.734 | 0.028 |
| −0.233 | 3.734 | 0.081 |
| −0.234 | 3.734 | 0.133 |
| −0.233 | 3.734 | 0.186 |
| −0.231 | 3.734 | 0.239 |
| −0.228 | 3.734 | 0.291 |
| −0.224 | 3.734 | 0.343 |
| −0.219 | 3.734 | 0.394 |
| −0.212 | 3.734 | 0.445 |
| −0.204 | 3.734 | 0.495 |
| −0.195 | 3.734 | 0.545 |
| −0.184 | 3.734 | 0.594 |
| −0.171 | 3.734 | 0.643 |
| −0.157 | 3.734 | 0.690 |
| −0.141 | 3.734 | 0.737 |
| −0.123 | 3.734 | 0.783 |
| −0.104 | 3.734 | 0.828 |
| −0.083 | 3.734 | 0.872 |
| −0.060 | 3.734 | 0.915 |
| −0.035 | 3.734 | 0.956 |
| −0.024 | 3.734 | 0.973 |
| −0.022 | 3.734 | 0.977 |
| −0.019 | 3.734 | 0.981 |
| −0.016 | 3.734 | 0.984 |
| −0.013 | 3.734 | 0.987 |
| −0.010 | 3.734 | 0.989 |
| −0.007 | 3.734 | 0.990 |
| −0.004 | 3.734 | 0.990 |
| −0.002 | 3.734 | 0.989 |
| −0.001 | 3.734 | 0.987 |
| 0.000 | 3.734 | 0.985 |
| 0.001 | 3.734 | 0.981 |
| 0.001 | 3.734 | 0.977 |
| 0.000 | 3.734 | 0.973 |
| −0.001 | 3.734 | 0.968 |
| −0.002 | 3.734 | 0.964 |
| −0.003 | 3.734 | 0.959 |
| −0.018 | 3.734 | 0.913 |
| −0.032 | 3.734 | 0.868 |
| −0.046 | 3.734 | 0.822 |
| −0.059 | 3.734 | 0.775 |
| −0.072 | 3.734 | 0.728 |
| −0.084 | 3.734 | 0.680 |
| −0.095 | 3.734 | 0.632 |
| −0.105 | 3.734 | 0.583 |
| −0.115 | 3.734 | 0.534 |
| −0.123 | 3.734 | 0.484 |
| −0.130 | 3.734 | 0.433 |

TABLE 1-continued

| X | Y | Z |
|---|---|---|
| −0.137 | 3.734 | 0.382 |
| −0.142 | 3.734 | 0.330 |
| −0.147 | 3.734 | 0.278 |
| −0.150 | 3.734 | 0.226 |
| −0.153 | 3.734 | 0.173 |
| −0.155 | 3.734 | 0.120 |
| −0.156 | 3.734 | 0.068 |
| −0.157 | 3.734 | 0.015 |
| −0.157 | 3.734 | −0.038 |
| −0.157 | 3.734 | −0.091 |
| −0.156 | 3.734 | −0.143 |
| −0.155 | 3.734 | −0.195 |
| −0.154 | 3.734 | −0.247 |
| −0.153 | 3.734 | −0.298 |
| −0.151 | 3.734 | −0.349 |
| −0.150 | 3.734 | −0.399 |
| −0.148 | 3.734 | −0.449 |
| −0.146 | 3.734 | −0.498 |
| −0.145 | 3.734 | −0.547 |
| −0.143 | 3.734 | −0.595 |
| −0.142 | 3.734 | −0.644 |
| −0.140 | 3.734 | −0.691 |
| −0.140 | 3.734 | −0.710 |
| −0.140 | 3.734 | −0.713 |
| −0.140 | 3.734 | −0.716 |
| −0.141 | 3.734 | −0.719 |
| −0.143 | 3.734 | −0.721 |
| −0.145 | 3.734 | −0.723 |
| −0.147 | 3.734 | −0.725 |
| −0.150 | 3.734 | −0.725 |
| −0.153 | 3.734 | −0.726 |
| −0.156 | 3.734 | −0.725 |
| −0.159 | 3.734 | −0.725 |
| −0.161 | 3.734 | −0.723 |
| −0.163 | 3.734 | −0.721 |
| −0.165 | 3.734 | −0.719 |
| −0.166 | 3.734 | −0.716 |
| −0.166 | 3.734 | −0.713 |
| −0.167 | 3.734 | −0.709 |

Figure 11:
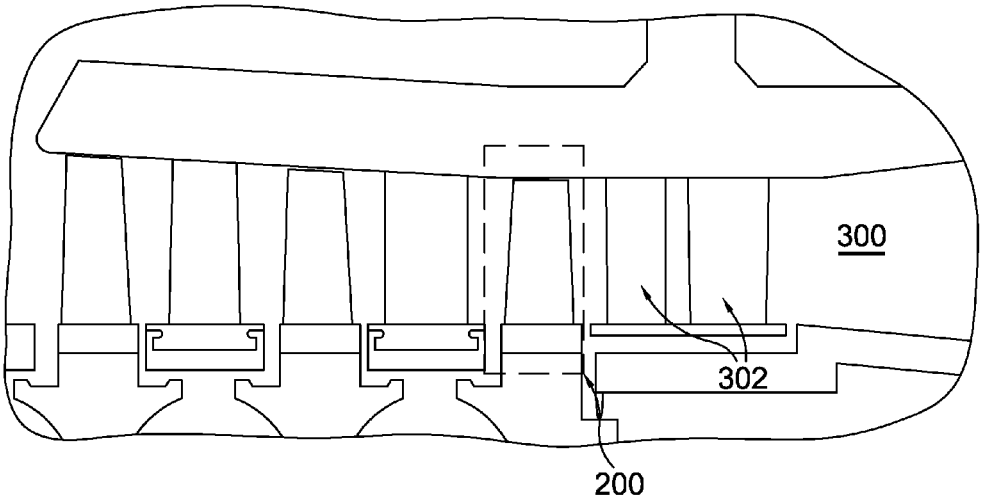
FIG. 11 is a cross section view of a portion of a compressor including a portion of a diffuser.

In addition to the structural improvements gained by the reconfigured airfoil shape of compressor component 200, the present invention also helps to improve overall compressor performance by improving the performance at the compressor diffuser 300. The compressor diffuser 300, as one skilled in the art understands and as shown in FIG. 11, receives the compressed air from an engine compressor at inlet region 302 and directs the air to the combustor(s). Due to the configuration of diffuser 300 and its support structure, efficiency losses are expected within the diffuser. In an embodiment of the invention, compressor component 200 is positioned in the last stage of rotating compressor blades and is the last point where it is possible to modify the total pressure profile along the height of the compressor section entering the diffuser. Efficiency losses at this stage are especially undesirable. Therefore, because of the improved airfoil configuration of compressor component 200, especially at its blade tip, the last stage of compressor blades is able to impart additional energy to the compressor and improve efficiency in the diffuser. Based on the aerodynamic changes described above, an increase in overall efficiency of approximately 0.2% is expected across the compressor and diffuser.

In order to introduce more energy through this last stage of the compressor, it is necessary to energize the flow in the regions near the compressor walls, which requires a greater pressure rise at the blade tip and root sections. However, because of the boundary layer present in these same areas, increasing pressure in these locations can be difficult. Pressure can be increased by increasing the amount of turning in these regions, as shown in FIGS. 6-8. To increase the turning, for a given airfoil chord length, the camber, or arc shape of the airfoil must be increased. However, with an increase in camber comes flow separation as the passing airflow approaches the airfoil trailing edge. To minimize flow separation for an airfoil with increased camber, the chord length of the airfoil must be adjusted wherever possible, as shown in FIGS. 5-8. That is, geometric constraints of the compressor component 200 must be balanced with structural integrity constraints in order to improve overall compressor efficiency.

Due to the changes in the physical profile of compressor component 200, the present invention airfoil profile also alters the natural frequency of the compressor component 200. As a result previously-damaging engine crossings, especially with the $7^{th}$ mode, have been eliminated and are depicted by the Campbell diagrams of FIG. 10.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A compressor component comprising:

an attachment for securing the compressor component to a disk; and, an airfoil extending radially outward from the attachment, the airfoil having a leading edge and a trailing edge with the trailing edge spaced a distance from the leading edge and separated by concave and convex surfaces;

wherein the airfoil has an uncoated profile substantially in accordance with Cartesian coordinate values of Table 1 having a set of X, Y, and Z coordinates, where the Y coordinate extends in a radially outward direction.

2. The compressor component of claim 1, wherein the airfoil is solid.

3. The compressor component of claim 1, wherein the compressor component is a rotating compressor blade.

4. The compressor component of claim 1, wherein the coordinate values of Table 1 are measured relative to a center plane datum located approximately 0.205 inches from a bottom surface of the attachment.

5. The compressor component of claim 1, wherein the airfoil and attachment are fabricated from a stainless steel alloy.

6. The compressor component of claim 1 further comprising a corrosion resistant coating applied to the airfoil.

7. The compressor component of claim 1, wherein the airfoil has a surface profile of approximately +/− 0.008 inches from nominal.

8. The compressor component of claim 1, wherein the airfoil is scalable by a factor of approximately 0.8-1.2.

9. A rotating compressor blade comprising:

an attachment having at least one contact surface for mating with a blade disk; and, an airfoil extending radially outward from the attachment, the airfoil having an uncoated profile substantially in accordance with Cartesian coordinate values of X and Z, for each distance Y in inches as set forth in Table 1, wherein Y is a distance measured radially outward from a datum plane extending through the attachment, the X and Z coordinate values being joined in smooth continuing splines to form airfoil sections and the airfoil sections joined smoothly to form the profile.

10. The rotating compressor blade of claim 9 further comprising a corrosion resistant coating applied to the airfoil.

11. The rotating compressor blade of claim 10, wherein the coating is applied approximately 0.001-0.003 inches thick.

12. The rotating compressor blade of claim 9, wherein the airfoil can be scaled by a factor ranging from approximately 0.8-1.2 such that the blade can be utilized in alternate size engines.

13. The rotating compressor blade of claim 9, wherein a concave surface and convex surface each extend radially outward to a generally planar tip of the blade.

14. The rotating compressor blade of claim 13, wherein each of the concave and convex surfaces have a surface profile of approximately +/−0.008 inches from nominal.

15. The rotating compressor blade of claim 9, wherein the Y coordinate values are measured a distance approximately 0.205 inches from a bottom surface of the attachment.

16. An airfoil for a compressor component having an uncoated profile substantially in accordance with Cartesian coordinate values of X and Z, for each distance Y in inches as set forth in Table 1, wherein Y is a distance measured radially outward from a center datum plane extending longitudinally through an attachment, the X and Z coordinate values being joined in smooth continuing splines to form airfoil sections and the airfoil sections joined smoothly to form the profile.

17. The airfoil of claim 16 having manufacturing tolerances of approximately +/−0.004 inches.

18. The airfoil of claim 17 further comprising a coating applied to at least a portion of the airfoil, the coating having a thickness of approximately 0.001-0.003 inches.

19. The airfoil of claim 16, wherein the compressor component is a rotating blade.

20. The airfoil of claim 16, wherein the airfoil sections can be scaled larger or smaller uniformly.

* * * * *